US005320539A

United States Patent [19]

Haskins

[11] Patent Number: 5,320,539

[45] Date of Patent: Jun. 14, 1994

[54] LAMP SOCKET

[75] Inventor: Steve W. Haskins, Sparta, Tenn.

[73] Assignee: Cooper Industries, Inc., Houston, Tex.

[21] Appl. No.: 30,712

[22] Filed: Mar. 12, 1993

[51] Int. Cl.[5] ..... H01R 9/09

[52] U.S. Cl. ..... 439/56; 439/558

[58] Field of Search ..... 439/56, 77, 356, 554, 439/558; 313/318

[56] References Cited

U.S. PATENT DOCUMENTS

| | | | |
|---|---|---|---|
| 2,704,833 | 3/1955 | Heller | 439/558 X |
| 2,982,939 | 5/1961 | Kirk | 439/56 X |
| 3,354,423 | 11/1967 | Garcia | 439/558 |
| 3,702,455 | 11/1972 | Raynor et al. | 439/56 X |
| 4,152,622 | 5/1979 | Fitzgerald | 439/56 X |
| 4,740,162 | 4/1988 | Marshall | 439/56 |
| 5,160,277 | 11/1992 | Fitzgerald et al. . | |

*Primary Examiner*—Khiem Nguyen

*Attorney, Agent, or Firm*—Burns, Doane, Swecker & Mathis

[57] ABSTRACT

A lamp assembly for being installed in circuit boards and the like comprises a lamp-receiving socket that can be inserted and removed from an opening of the circuit board in an axial direction without being rotated. The socket includes snap arms which have cam follower surfaces enabling the snap arms to be elastically flexed to retracted positions as the socket is installed.

6 Claims, 1 Drawing Sheet

FIG. 1
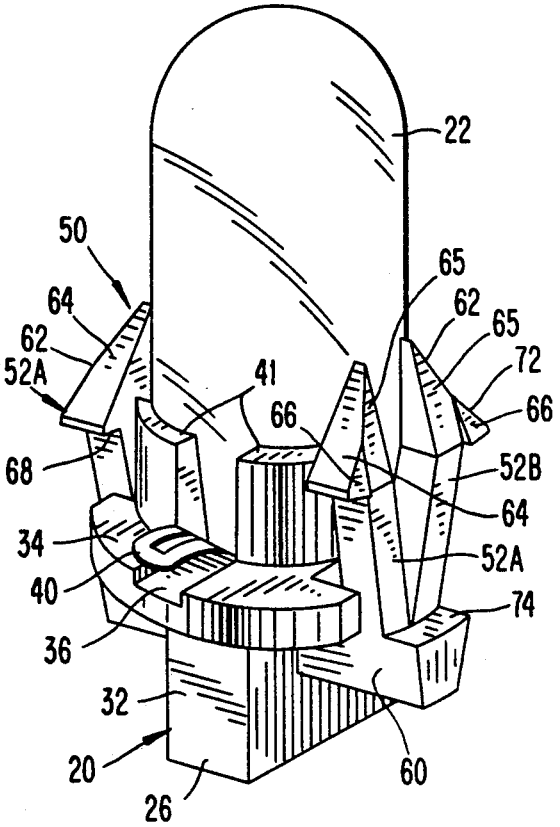
FIG. 2
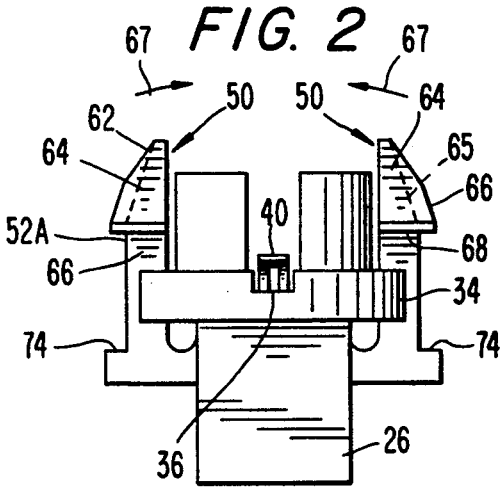
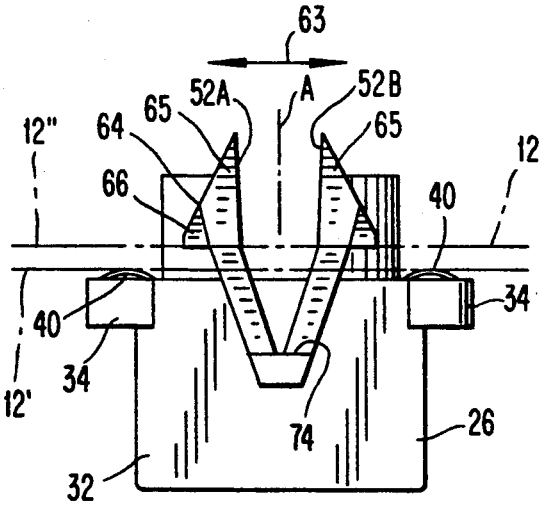
FIG. 3
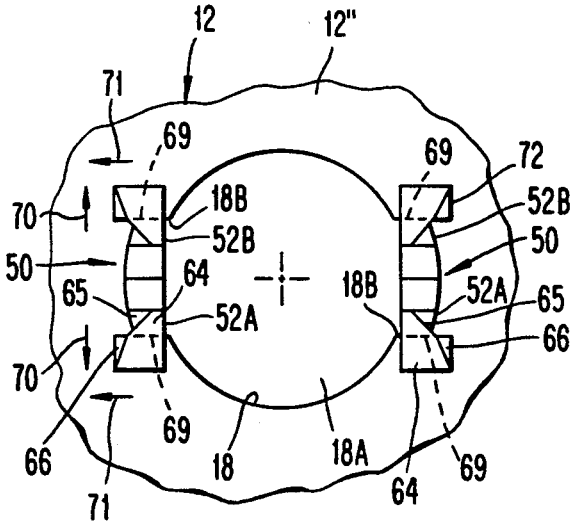
FIG. 4

LAMP SOCKET

BACKGROUND OF THE INVENTION

The present invention relates to a lamp socket adapted to be mounted in a circuit plate such as a printed circuit board or a flex circuit.

Automobile dash panels typically have lamp assemblies mounted therein to provide visual indication and warning signals. The lamp assemblies are mounted in a circuit plate such as a printed circuit board or a flex circuit affixed to a panel. A common practice has been to provide a lamp assembly in the form of a socket and lamp, and attach the lamp assembly to the circuit plate by inserting the socket axially into an opening in the circuit plate, and then rotating the socket in order to lock the socket in the circuit plate. In so doing, electric terminals carried by the socket slide along the panel and make electrical connection with the circuit. Those steps are performed in reverse sequence to remove the socket.

Problems resulting from that procedure include the risk that the terminal may tear the circuit as it slides thereacross during installation or removal, especially in the case of a flex circuit.

Sockets have been previously proposed which do not require rotation for installation, e.g., see commonly assigned Fitzgerald et al U.S. Pat. No. 5,160,277. In the arrangement described in that patent, insertion of the socket is performed in the axial direction, whereupon locking lips of the socket become flexed and then snap-out on the opposite side of the circuit plate to prevent axial removal of the socket. When it is desired to remove the socket, the socket is rotated to bring the locking lips into axial alignment with apertures of the panel so that the socket can be displaced axially through the panel. Thus, it will be appreciated that the circuit could be damaged during removal of the socket. Even if the rotation step were omitted during socket removal by simply forcing the socket axially through the opening in a manner breaking-off the locking lips, such a procedure would be undesirable because it would leave the broken-off locking lips in the dash panel.

Therefore, it would be desirable to provide a lamp assembly which can be installed and removed from a circuit plate without having to rotate the socket, and without leaving broken-off pieces of the socket behind.

It would also be desirable to reduce the area of the circuit surface which is occupied by an installed socket, i.e., to reduce the size of the "footprint" of the socket on the circuit plate.

SUMMARY OF THE INVENTION

The present invention relates to a socket for receiving a lamp to mount the lamp into a circuit plate which has an opening therethrough for receiving the socket. The socket comprises a body forming an aperture which defines a longitudinal axis. The aperture is open in a forward axial direction for receiving the lamp. Electric terminals are disposed on the body for making contact with a circuit carried by the circuit plate. A releasable locking structure is carried by the body for releasably locking the socket to the circuit plate. The locking structure comprises a plurality of snap members. Each snap member has a forwardly facing cam follower arrangement engageable with a first side of the circuit plate to displace the snap member to a retracted position to permit the body to be forced axially through the opening in the circuit plate, whereafter the snap member snaps back to a locking state for locking the socket to the circuit plate.

Preferably, each snap member comprises a snap arm having a mounting end integrally joined to the body, and a free end having a locking head which forms the cam follower arrangement. Each snap arm is elastically flexible about its mounting end. The locking head forms a shoulder which overlies a second surface of the circuit plate to lock the socket thereto. The shoulder extends past the opening of the circuit plate in directions oriented both tangentially and radially with reference to the axis. Therefore, the cam follower arrangement flexes the locking head in tangential and radial directions as the locking head passes through the opening.

Preferably, the snap arms are arranged in pairs, the snap arms of each pair being situated so that they are flexed toward one another during passage of the body through the opening of the circuit plate.

Preferably, the body and snap members are of one piece molded plastic construction.

The present invention also relates to a combination of the circuit plate and the lamp assembly.

BRIEF DESCRIPTION OF THE DRAWINGS

The objects and advantages of the invention will become apparent from the following detailed description of preferred embodiments thereof in connection with the accompanying drawing in which like numerals designate like elements and in which:

FIG. 1 is a perspective view of a lamp assembly according to the present invention, with a lamp mounted therein;

FIG. 2 is an end elevational view of a socket element of the lamp assembly, with the lamp removed therefrom;

FIG. 3 is a side elevational view of the socket element shown in FIG. 2, with a circuit plate depicted in phantom lines; and FIG. 4 is a schematic view of a circuit plate depicting the manner in which snap arms of the socket element would engage a surface of the circuit plate.

DETAILED DESCRIPTION OF A PREFERRED EMBODIMENT OF THE INVENTION

Depicted in FIG. 1 is a lamp assembly 10 which is to be mounted in a circuit plate 12 (see FIGS. 3 and 4) such as a printed circuit board or a flex circuit mounted on a panel. The circuit plate carries an electrical circuit having terminals. A bow-tie shaped opening 18 extends completely through the circuit plate 12 from a first side 12' to a second 12" side thereof. The opening 18 includes a circular center portion 18A and a pair of slots 18B extending radially outwardly.

The lamp assembly 10 comprises a socket 20 and a lamp 22 mounted in an aperture formed in a body 26 of the socket. The aperture defines a longitudinal axis A and is open at its axially forward end to receive the lamp 22.

The body includes a generally rectangular rear portion 32, and a pair of flanges 34 projecting radially outwardly from a front portion of the body. Those flanges 34 are spaced apart circumferentially (with reference to the axis A) by 180 degrees. Each flange extends circumferentially for about ninety degrees.

Formed in each flange 34 is a radial depression 36, which extends to the aperture 24. Projecting from the aperture 24 are the front ends of two electrically conductive metal terminals 40. The terminals 40 overlie respective depressions 36 and are pressed into the depressions 36 when the socket 10 is mounted to the circuit plate 12 (see FIG. 3). Attention is directed to the present inventor's U.S. application Ser. No. 08/030,716, filed concurrently herewith for a more detailed description of the contacts 40. The disclosure of that application is incorporated herein by reference.

Projecting axially forwardly at a front end of the aperture 24 are circumferentially spaced guide fingers 41 which guide and support the lamp 22 when the latter is inserted into the body.

Joined to the body 26 are two pairs 50 of spaced-apart snap arms 52A, 52B. The pairs 50 are spaced circumferentially apart by 180 degrees, and each pair 50 is spaced circumferentially from each terminal 40 by 90 degrees. The snap arms 52A, 52B of each pair are of identical configuration, and extend generally axially forwardly. Each snap arm includes a mounting end 60 joined integrally with the body 26, and a free end on which a locking head 62 is formed. The snap arm is elastically flexible about its mounting end, to enable the locking head 62 to move in the direction indicated by the arrow 63, i.e., generally tangentially with respect to the axis A.

The locking head 62 comprises a plurality of cam follower faces 64, 65, 66 which face generally forwardly. Each cam follower face 64 is oriented such that when the socket is pushed forwardly through the opening 18 of the circuit plate, engagement between the cam follower face 64 and the first side 12' of the circuit plate causes the associated snap arm to be flexed in a direction which is tangential relative to the axis A, i.e., in the direction of arrow 63 in FIG. 3. Thus, the snap arms of each pair 50 are caused to be flexed toward one another to a retracted position.

Each cam follower surface 65 is oriented such that during insertion of the socket, engagement between the cam follower face 65 and the first side 12' of the circuit plate causes the associated snap arm to be flexed radially inwardly toward the axis A, i.e., in the direction of arrow 67 in FIG. 2.

Each cam follower face 66 likewise causes the associated snap arm to be flexed in the direction of the arrow 67.

The flexing of the snap arms in the direction of arrows 63, 67 enables the locking heads 62 to pass through the slots 18B of the opening 18 in the circuit plate. Then, the snap arms will snap back so that a rearwardly facing shoulder 68 of each locking head comes into overlying relationship with the second surface 12" of the circuit plate and thereby prevents unintended removal of the socket.

In the locking state, each shoulder extends past an associated edge 69 of the slot 18B in a tangential direction (i.e., in the direction of arrows 70 in FIG. 4) and also in the radial direction (i.e., in the direction of arrows 71 in FIG. 4). The portion of the shoulder which extends radially past the slot is disposed on a projection 72 of the locking head 62 on which the cam follower surface 66 is disposed.

By shaping the shoulder 68 to extend past the slot in both tangential and radial directions, the socket will resist dislodgement when the rectangular portion 32 of the socket is subjected to a force in any direction parallel to the plane of the circuit plate.

The surface which defines the shoulder 68 is depicted as being oriented parallel to the plane of the circuit plate, but other orientations are possible. That is, in the case of larger size sockets, it may be desirable to incline that shoulder surface such that it defines a cam follower surface that promotes a flexing of the snap arms tangentially toward the retracted position when the socket is being deliberately removed from the circuit plate by the application of a rearward axial force to the socket.

In the case of smaller side sockets, where the snap arms are less stiff than in the larger sockets, it has been found that the depicted non-inclined shoulder surfaces will permit the snap arms to be retracted during the application of a rearward force during an intentional removal procedure.

The rearward axial force can be applied to a pair of ledges 74 which project radially outwardly from the mounting portions 60 of the snap arms.

In practice, the socket 20 is installed by being pushed axially forwardly into the opening 18 with the pairs 50 of snap arms generally aligned with respective slots 18B. Accordingly, the lamp 22 passes through the center portion 18A, and the snap arms 52A, 52B pass through the slots 18B. As this occurs, the first side 12' of the circuit plate is engaged by respective front cam follower surfaces 64, 65, 66 to cause the snap arms to flex. The flexing occurs such that the snap arms 52A, 52B of each pair are displaced tangentially toward one another and radially inwardly toward the axis A to retracted positions in order to fit through the respective slot 18B. Once the locking heads 62 have traveled through the slots, the snap arms snap back to their normal or relaxed state whereby the shoulders 68 overlie portions of the second side 12" located both radially and tangentially outwardly of the slot to resist rearward axial travel of the socket 20 (see FIG. 4). In this condition of the socket, the terminals 40 of the socket contact the terminals of the circuit.

When it is desired to remove the socket 20, it is gripped at the gripping surfaces 74 and pulled rearwardly. The application of sufficient force causes the snap arms 52A, 52B of each pair 50 to flex tangentially and radially into their retracted positions to enable the snap arms 52A, 52B to fit through the slots 18B.

As noted earlier, it might be desirable, in the case of larger sockets, to shape the shoulders 68 as inclined cam follower surfaces to promote the flexing of the snap arms to the retracted state.

It will thus be appreciated that the socket can be installed and removed relative to the circuit plate without rotation about the axis A and without leaving broken pieces behind. This simplifies installation and removal and ensures that the terminals 40 of the socket will not tear the circuit.

Moreover, the inclined cam follower surfaces 64, 65, 66 of the snap arms function, upon engaging the circuit plate, to bring the snap arms into proper alignment relative to the opening 18. Thus, precise initial alignment of the snap arms 52A, 52B with the slots 18B is not required.

It will also be appreciated that the footprint of the socket on the circuit plate is relatively small, since both the flanges 34 together extend circumferentially for only about 180 degrees. The remainder of the circumference is occupied by the pairs 50 of snap arms which extend radially from the axis A for a relatively short distance. Notwithstanding this smaller footprint, the socket will fit standard-sized openings 18.

The configuration of socket 20 lends itself to manufacture by molding. Accordingly, the entire socket excepting the terminals 40, i.e., the body 26, flanges 34, snap arms 52A, 52B and ledges 74, are preferably of one-piece molded plastic construction.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A socket for receiving a lamp to mount the lamp into a circuit plate which has an opening therethrough for receiving the socket, said socket comprising:

a body forming an aperture which defines a longitudinal axis, said aperture being open in a forward axial direction for receiving the lamp, electrical terminals disposed on the body and including circuit-contacting portions for making contact with a circuit carried by the circuit plate, said circuit-contacting portions extending generally radially outwardly from said aperture, and releasable locking means carried by said body for releasably locking said socket to the circuit plate, said locking means comprising only two pairs of snap arms, one said pair being located diametrically opposite the other said pair with reference to said longitudinal axis, each snap arm having a mounting end integrally joined to said body, and a free end, each snap arm being elastically flexible about its mounting end, said free end having forwardly facing cam follower means engageable with a first side of the circuit plate to flex said snap arm to a retracted position to permit said body to be forced axially forwardly through the opening in the circuit plate, whereafter said snap arm snaps back to a locking state for locking said socket to the circuit plate, said free end being defined by a locking head which forms said cam follower means and also forms a shoulder which overlies a second side of the circuit plate when its snap arm is in said locking state, each snap arm being flexible between its retracted position and locking state independently of the other snap arm of the same pair and also independently of both snap arms of the other pair, each snap arm being flexible toward the other snap arm of the same pair when moving to its retracted position, said circuit-contacting portions of said terminals being located generally diametrically opposite one, another and each circuit-contacting portion being situated circumferentially between said pairs of snap arms, said body and snap arms being of one-piece molded plastic construction.

2. A socket according to claim 1, wherein said terminals are spaced circumferentially apart by 180 degrees and each terminal is spaced from each pair of snap arms by 90 degrees.

3. A socket according to claim 1, wherein said snap arms of each of said pairs have their cam follower means arranged to flex said snap arms tangentially toward each other and radially toward said axis, said cam follower means of each snap arm comprising first and second cam follower faces arranged non-coplanar relative to one another and oriented to flex said snap arm in tangential and radial directions, respectively.

4. In combination, a circuit plate and a lamp assembly, said circuit plate including an electric circuit, first and second sides, and an opening extending completely through said first and second sides, said opening comprising a generally circular center portion and a pair of circumferentially extending slots protruding outwardly from diametrically opposed sections of said center portion, said lamp assembly comprising a socket and a lamp mounted in a forwardly open aperture of said socket, said socket comprising:

a body forming said aperture, said aperture defining a longitudinal axis, electrical terminals disposed on said body for making contact with said circuit, and releasable locking means carried by said body for releasably locking said socket to the circuit plate, said locking means comprising two pairs of snap arms formed of plastic and being of one-piece construction with said body, said two pairs of snap arms being insertable through respective ones of said slots, each snap arm having a mounting end integrally joined to said body, and a free end, each snap arm being elastically flexible about its mounting end, said free end having forwardly facing cam follower means engageable with a first side of the circuit plate to flex said snap arm to a retracted position to permit said body to be forced axially forwardly through the opening in the circuit plate and each snap arm through its respective slot, whereafter said snap arm snaps back to a locking state for locking said socket to the circuit plate, said free end being defined by a locking head which forms said cam follower means and also forms a shoulder which overlies a second side of the circuit plate when its snap arm is in said locking state, said cam follower means of each snap arm comprising first and second cam follower faces arranged non-coplanar relative to one another and oriented to flex said snap arm in tangential and radial directions, respectively.

5. A socket according to claim 4, wherein said plurality of snap arms comprises only two pairs of snap arms.

6. A socket for receiving a lamp to mount the lamp into a circuit plate which has an opening therethrough and receiving the socket, said socket comprising:

a body forming an aperture which defines a longitudinal axis, said aperture being open in a forward axial direction for receiving the lamp, electrical terminals disposed on the body for making contact with a circuit carried by the circuit plate, and releasable locking means carried by said body for releasably locking said socket to the circuit plate, said locking means comprising a plurality of snap arms formed of plastic and being of one-piece construction with said body, each snap arm having a mounting end integrally joined to said body, and a free end, each snap arm being elastically flexible about its mounting end, said free end having forwardly facing cam follower means engageable with a first side of the circuit plate to flex said snap arm to a retracted position to permit said body to be forced axially forwardly through the opening in the circuit plate, whereafter said snap arm snaps back to a locking state for locking said socket to the circuit plate, said free end being defined by a locking head which forms said cam follower means and also forms a shoulder which overlies a second side of the circuit plate when its snap arm is in said locking state, said snap arms comprising pairs of snap arms, said snap arms of each pair having their cam follower means arranged to flex said snap arms tangentially toward each other and radially toward said axis, said cam follower means of each snap arm comprising first and second cam follower faces arranged non-coplanar relative to one another and oriented to flex said snap arm in tangential and radial directions, respectively.

* * * * *